United States Patent [19]

Roques-Rogery

[11] 4,001,894

[45] Jan. 11, 1977

[54] PROTECTIVE HELMET

[75] Inventor: Gérard Roques-Rogery, Vineuil Saint Firmin, France

[73] Assignee: S.I.D.A.C. S.A., Paris, France

[22] Filed: Apr. 19, 1974

[21] Appl. No.: 462,578

[30] Foreign Application Priority Data

Apr. 20, 1973 France ..... 73.14537

[52] U.S. Cl. ..... 2/415; 2/15

[51] Int. Cl.[2] ..... A42B 3/02

[58] Field of Search ..... 2/2, 3 R, 3 A, 3 B, 2/3 C, 5, 6

[56] References Cited

UNITED STATES PATENTS

| | | | |
|---|---|---|---|
| 3,039,108 | 6/1962 | Lohrenz | 2/3 R |
| 3,500,475 | 3/1970 | Otsuka | 2/3 R |
| 3,548,410 | 12/1970 | Parker | 2/3 R |
| 3,628,190 | 12/1971 | Molitoms | 2/3 A |

*Primary Examiner*—Alfred R. Guest

*Attorney, Agent, or Firm*—Cameron, Kerkam, Sutton, Stowell & Stowell

[57] ABSTRACT

A protective helmet, comprising, in combination, an open shell (or bell) covering the wearer's head and provided, in register with the wearer's eyes, with a transverse opening said shell being internally coated with at least one layer of appropriate thickness made of an elastic and resilient material, adapted to dampen shocks, and a hood with ears, directly fixed to the inside of the shell and adapted to be tightly wrapped over the wearer's skull, nape and temples, said hood being an extention of said shell and being provided with side straps for securing the helmet under the wearer's chin.

1 Claim, 2 Drawing Figures

PROTECTIVE HELMET

The present invention generally relates to a protective helmet, in particular to be used in the field of motor-bicycles or sporting vehicles, where the basic safety driving regulation make it compulsory to wear such a protective device.

Quite a number of protective helmets are already known, in particular those in the form of a shell (or bell) open at the lower portion thereof, said shell wrapping all the wearer's head and comprising, in register with the eyes of the latter, a transverse opening defined by a resilient bead, or flange, such a helmet thus being able to protect not only the wearer's skull and temples but his nape and jaw bones as well. In articles of such a type, the helmet shell, which is made of a tight alloy or a hard plastic material, is internally coated with one or several layers of a resilient material of suitable thickness, usually a synthetic material such as expanded polyurethane, these layers which provide a satisfactory comfort for the wearer being covered, inside of the helmet, with a hood of plastic fabric or the like connected, at the lower portion of the helmet, to the periphery of the opening through which is engaged the wearer's head.

Two straps, attached to the inner lateral sides of the rigid shell and interconnected under the wearer's chin, permit to secure the helmet to the wearer's head. Now, in such types of helmets, the fixing means is not entirely satisfactory, since the helmet is not firmly held and is likely to slide on the wearer's head, which is a nuisance.

The invention aims at a protective helmet devoid of such drawbacks. To this end, the helmet according to the invention is characterized in that it comprises, in combination, an open shell (or bell) covering the wearer's head and provided, in register with the wearer's eyes, with a transverse opening, said shell being internally coated with at least one layer of appropriate thickness made of a soft and resilient material, adapted to dampen shocks, and a hood with ears directly fixed to the inside of the shell and adapted to be tightly wrapped over the wearer's skull, nape and temples, said hood being an extension of said shell and being provided with side straps for securing the helmet under the wearer's chin. According to a particular feature of the invention, the shell and the hood are interconnected along a substantially circular contact zone inside of the shell, where said hood is stuck or otherwise fixed to the internal coating layer.

Preferably, the hood comprises two thicknesses of synthetic fabric between which is inserted a layer of resilient material.

Other features of the invention will appear from the following description given merely by way of example, with reference to the drawing, in which.

Figure 1:
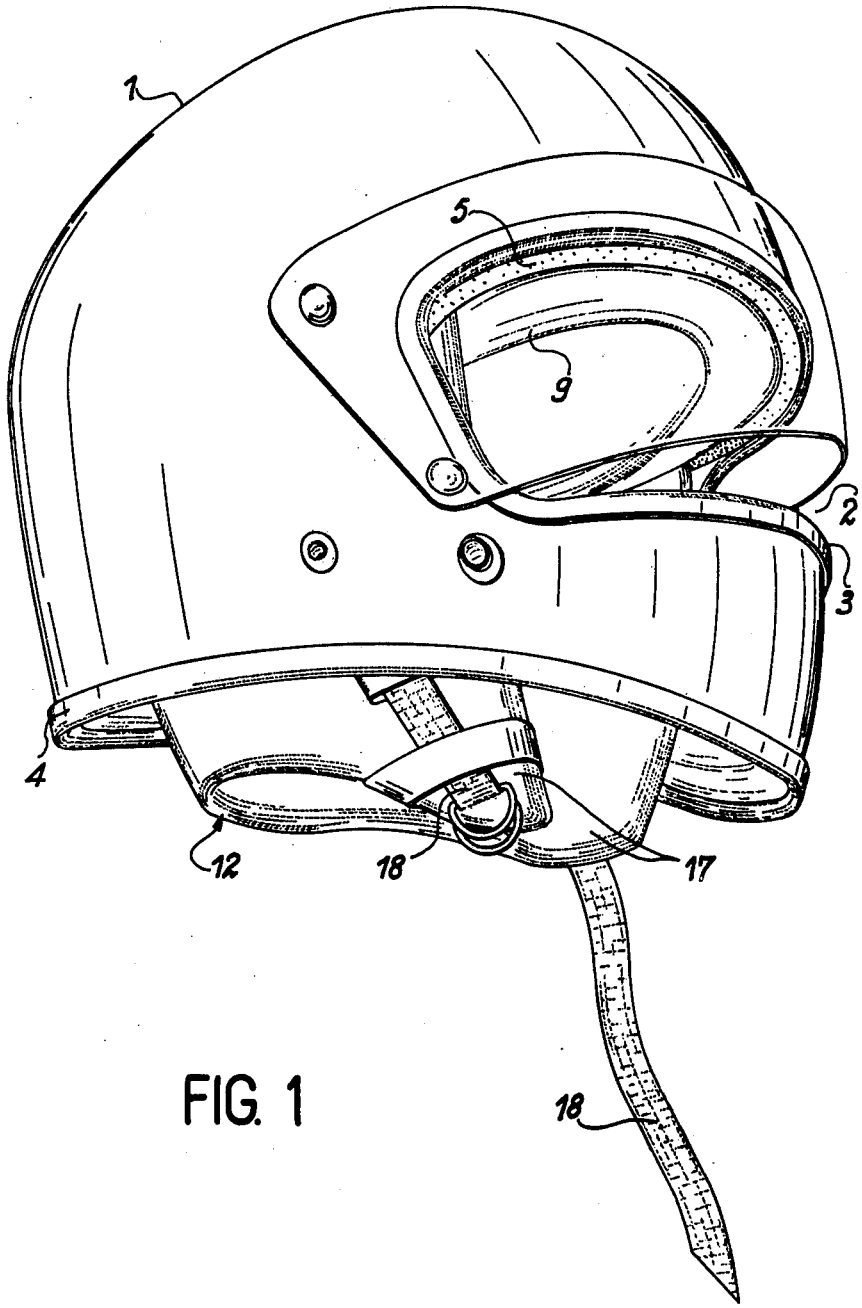
FIG. 1 is a perspective view of a helmet according to the invention.
Figure 2:
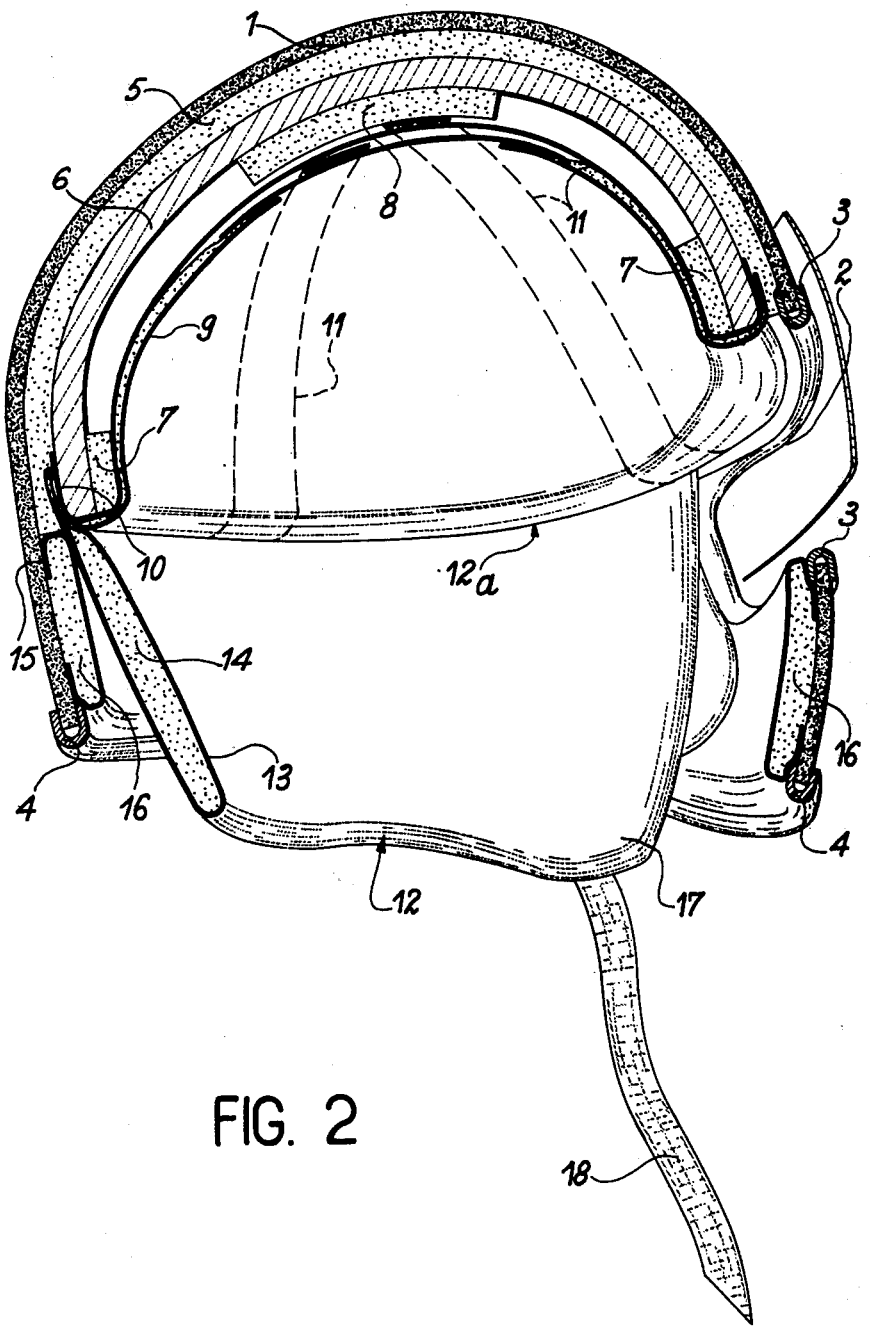
FIG. 2 is a cross-section through FIG. 2.

As shown in the drawing, the helmet according to the invention comprises an open shell (or bell) 1, of light alloy or of hardened plastic material, of a conventional type known per se.

This shell 1, which is open at the lower end thereof, is provided, in its front face, in register with the wearer's eyes, with a wide transverse opening 2 defined by a resilient bead, or flange, 3. Again, the open lower portion of shell 1 is surrounded by a protective bead, or flange, 4.

The inside surface of shell 1 is coated with one or several layers, such as shown at 5 and 6, of synthetic material, provided with damping properties against shocks, so as to protect the wearer's head. Preferably, layers 5 and 6 are made of a synthetic material, e.g. expanded polyurethane.

In addition, inner layer 6 is provided with pads 7 and 8, adapted to support the bottom portion of an internal hood 9 and applied against said beads, thus ensuring the contact with the upper portion of the wearer's head, said hood 9, which is of plastic fabric or the like, being extended by a brim 10 inserted between layers 5 and 6. Preferably hood 9 is tightened by substantially radial straps 11 which permit to suitably position the helmet on the wearer's head.

According to the invention, the thus made helmet is combined with a hood 12 provided with ears, which is mounted inside of shell 1, and made integral with the latter along a substantially circular zone 12*a*. Preferably, that hood with ears comprises two thicknesses 13 of plastic fabric or the like, between which is inserted a layer 14 of suitable thickness, made of a resilient material.

Preferably, the side portions of hood 12 are extended by a tongue 15 which is directly stuck to the inside surface of shell 1, a crown 16 of resilient plastic material being inserted therebetween. Finally, hood 12 is provided with lateral ears 17 extended by straps 18 adapted to be fastened under the chin of the wearer, thus firmly securing the helmet to the latter's head.

As compared to the helmets of the prior art which are fixed directly to the wearer's head by means of straps connected to the outer shell, the provision, according to the invention, of a hood 12 with ears integral with said outer shell permits to more securely immobilize the whole headgear, in view of the fact that said hood with ears entirely wraps the wearer's head, viz. not only the upper portion of his head but his nape and temples as well, said hood with ears, by means of its end straps, also providing a firm connection under the wearer's chin.

I claim:

1. A protective helmet, comprising, in combination, an open shell covering the wearer's head a transverse opening in said shell in register with the wearer's eyes, two layers of appropriate thickness of an elastic and resilient material secured with said shell to dampen shocks, an internal hood within said shell, a hood with ears directly fixed to the inside of the shell and tightly covering the wearer's skull, nape and temples, said hood with ears forming an extension of said shell, side straps for said hood with ears for securing the helmet under the wearer's chin, said shell and said hoods being interconnected along a substantially circular contact zone inside of said shell to said shell between said two layers, said hood comprising two thicknesses of synthetic fabric containing a layer of resilient material.

* * * * *